US007003835B2

(12) United States Patent
Figg, Jr. et al.

(10) Patent No.: US 7,003,835 B2
(45) Date of Patent: Feb. 28, 2006

(54) CABLE-STAY CRADLE SYSTEM

(75) Inventors: Eugene C. Figg, Jr., deceased, late of Tallahassee, FL (US); by Linda Figg, legal representative, Tallahassee, FL (US); W. Denney Pate, Tallahassee, FL (US)

(73) Assignee: Figg Bridge Engineers, Inc., Tallahassee, FL (US)

( * ) Notice: Subject to any disclaimer, the term of this patent is extended or adjusted under 35 U.S.C. 154(b) by 0 days.

(21) Appl. No.: 10/965,208

(22) Filed: Oct. 15, 2004

(65) Prior Publication Data

US 2005/0086751 A1 Apr. 28, 2005

Related U.S. Application Data

(62) Division of application No. 10/291,681, filed on Nov. 12, 2002, now Pat. No. 6,880,193.

(60) Provisional application No. 60/368,986, filed on Apr. 2, 2002.

(51) Int. Cl.
*E01D 11/00* (2006.01)

(52) U.S. Cl. ..... 14/21; 14/22; 14/77.1; 248/56

(58) Field of Classification Search ..... 14/18, 14/21, 22, 23, 77.1; 248/49, 56, 63, 68.1; 57/231

See application file for complete search history.

(56) References Cited

U.S. PATENT DOCUMENTS

| | | | | | |
|---|---|---|---|---|---|
| 285,257 | A | | 9/1883 | Griffith | |
| 430,428 | A | * | 6/1890 | Lindenthal | 14/21 |
| 513,389 | A | | 1/1894 | Greer | |
| 608,690 | A | | 8/1898 | Lindenthal | |
| 629,902 | A | | 8/1899 | Gunn | |
| 630,809 | A | | 8/1899 | Gunn | |
| 2,011,168 | A | | 8/1935 | Sunderland | |
| 2,402,408 | A | | 6/1946 | Johnston | |
| 2,457,427 | A | * | 12/1948 | Wolfard | 14/18 |
| 2,748,407 | A | | 6/1956 | Copp | |
| 3,491,393 | A | | 1/1970 | Neeld, Jr. et al. | |
| 3,548,432 | A | * | 12/1970 | Durkee et al. | 14/21 |
| 3,626,534 | A | | 12/1971 | Bell et al. | |
| 4,473,915 | A | | 10/1984 | Finsterwalder | |

(Continued)

*Primary Examiner*—Gary S. Hartmann
(74) *Attorney, Agent, or Firm*—Dykema Gossett PLLC

(57) ABSTRACT

A cable-stay cradle system ("cradle system") for cable stayed bridges is mounted onto a cable stay, the opposite ends of which are attached to anchors on a bridge deck. The cradle system is disposed along the length of the cable stay and located in a pre-formed opening in a pylon. The cradle system includes axially spaced sleeve centering plates that have radially spaced holes through which the cable strands of the cable stay are threaded. The cradle system ensures that a distance from center-points of adjacent cable strands remains essentially constant along the entire length of the cradle system. The invention also provides a method of installing a cable stay including a cradle system, which includes the steps of threading the cable stay through the opening in the pylon so as to locate the cradle system in the opening, and attaching the cable stay to anchors on the bridge deck.

8 Claims, 2 Drawing Sheets

U.S. PATENT DOCUMENTS 4,505,081 A * 3/1985 Dinis et al. ..... 52/223.14
4,633,540 A 1/1987 Jungwirth et al.
4,648,146 A * 3/1987 Nutzel et al. ..... 14/21
4,742,591 A 5/1988 Muller
4,799,279 A 1/1989 Muller
4,856,254 A 8/1989 Jungwirth
4,866,803 A 9/1989 Nedelcu
4,977,715 A 12/1990 Krumbach
5,121,518 A 6/1992 Muller
5,197,157 A 3/1993 De La Fuente
6,301,735 B1 * 10/2001 Jartoux et al. ..... 14/22
6,421,864 B1 * 7/2002 Daiguji et al. ..... 14/21
6,476,326 B1 * 11/2002 Fuzier et al. ..... 174/95
6,560,807 B1 * 5/2003 Stubler et al. ..... 14/22
6,658,684 B1 * 12/2003 Stubler et al. ..... 14/22

* cited by examiner

CABLE-STAY CRADLE SYSTEM

RELATED APPLICATIONS

The present application claims the benefit of priority to Parent application Ser. No. 10/291,681, filed Nov. 12, 2002, now U.S. Pat. No. 6,880,193 and Provisional Application Ser. No. 60/368,986, filed Apr. 2, 2002, hereby incorporated by reference in their entirety.

BACKGROUND OF INVENTION a. Field of Invention

The present invention relates generally to bridges, and more particularly, to cable stayed bridges in which cable stays are anchored to the bridge deck at one side of a pylon, extend through openings in the pylon, and are further anchored to the bridge deck at an opposite side of the pylon.

b. Description of Related Art

As shown in related art FIG. 1, in the past, cable stayed bridges have been constructed for example by anchoring cable stays 11, 12 to a bridge deck 13 by anchors 14, 15, respectively. Cable stays 11, 12 are further anchored to pylon 16 by anchors 17, 18, respectively. This conventional bridge construction technique has several drawbacks. For example, pylon 16 must be large enough to permit internal access during bridge construction for stressing operations of cable stays 11, 12, and for inspection of anchors 17, 18 after installation thereof. Installation of anchors 17, 18 is also costly and time consuming since each anchor must be individually installed and inspected thereafter. Moreover, anchors 17, 18 apply a high splitting force on pylon 16, which requires post-construction tensioning of cable stays 11, 12, and also requires significant reinforcement of pylon 16 to account for such stresses.

In the art, there currently exist various other conventional cable stayed bridge designs, as disclosed for example in U.S. Pat. Nos. 5,121,518, 4,799,279 and 4,742,591.

U.S. Pat. No. 4,799,279, for example, discloses a cable stayed bridge in which cables 36*a*, 36*b* are draped over the tops of pylon saddle sections 33*a*, 33*b* respectively, and are anchored at opposite ends of the bridge deck (see FIG. 8). It is apparent that instead of being anchored to pylon 33 as illustrated in the bridge construction technique shown in related art FIG. 1 of the present invention, cable stays 36*a* and 36*b* extend through suitable openings 38 in pylon 33. This bridge construction technique also has several similar disadvantages as compared to the bridge construction technique illustrated in related art FIG. 1 of the present invention. For example, referring to U.S. Pat. No. 4,799,279, the individual strands of cable which form cable stay 36 are in direct frictional contact with each other. This frictional interaction over a period of time causes wear, and therefore deteriorates the structural integrity of the individual cable strands and hence cable stay 36. Additionally, in the region of interaction between cable stay 36 and pylon 33, the bundle of cable strands have a tendency to bunch up and flatten themselves, which results in the strands themselves contacting and transferring a vertical compressive force onto pylon 33. Due to unpredictability of the manner in which the strands may bunch up, this vertical compressive force can be unevenly distributed and therefore result in premature deterioration of pylon 33. Moreover, this vertical compressive force also results in premature deterioration of the individual strands themselves, and is of concern in addition to the deterioration resulting from frictional interaction between the individual strands, as discussed above.

SUMMARY OF INVENTION

The present invention solves the problems and overcomes the drawbacks and disadvantages of prior art cable stayed bridge construction techniques by providing a cradle for a cable stay which eliminates the need for anchoring the individual cable stays to opposite sides of a pylon.

Another aspect of the present invention is to provide a cradle for a cable stay which maintains the individual strands in a cable stay in an essentially parallel relationship in the vertical deviation region of the cable stay (i.e. region of interaction with a pylon).

Yet another aspect of the present invention is to provide a cradle for a cable stay which transfers an essentially symmetrical compressive force onto a pylon in the region of interaction therewith.

Yet another aspect of the present invention is to provide a cost-effective means for replacing the conventional anchors attached to a pylon in cable stayed bridge construction.

Yet a further aspect of the present invention is to provide an efficient means of cable stayed bridge construction, and to provide an efficient and reliable means for inspection of individual strands in a cable stay after installation thereof on a bridge.

Specifically, the present invention provides a cable-stay cradle system for mounting a cable stay, including a plurality of cable strands, onto a bridge pylon. The cable-stay cradle system includes a curved sheath having a predetermined arc-length and a plurality of axially spaced sleeve centering plates having a plurality of radially spaced holes through which cable strands can be threaded. The cable-stay cradle system enables a distance from a center-point of a cable strand disposed in a hole, to a center-point of another cable strand disposed in an adjacent hole, to remain essentially constant along the arc-length of the sheath.

The present invention also provides a bridge deck support system including a cable stay having a plurality of cable strands. One end of the cable stay may be attached to a first anchor on a bridge deck and the other end of the cable stay may be attached to a second anchor on the bridge deck. A curved cable-stay cradle system having a predetermined arc-length, which is less than the length of the cable stay, is disposed along a length of the cable stay. The cable-stay cradle system includes axially spaced sleeve centering plates having radially spaced holes through which the cable strands are threaded. The cable-stay cradle system permits a distance from a center-point of a cable strand disposed in a hole, to a center-point of another cable strand disposed in an adjacent hole, to remain essentially constant along the arc-length of the cable-stay cradle system.

For the bridge deck support system described above, the cable stay may include a covering for partially enclosing the cable strands along their length. The cable-stay cradle system may include a protective sleeve for covering each of the cable strands. Each of the protective sleeves has a length substantially the same as the arc-length of the cable-stay cradle system. The cable-stay cradle system may include first and second outermost sleeve centering plates each having interior and exterior surfaces. Each of the protective sleeves is threaded through the holes in the sleeve centering plates, and further includes expanded portions at outer ends thereof adjacent the exterior surfaces of each of the outermost sleeve centering plates. The cable-stay cradle system may further include a sheath having a length substantially the same as the arc-length of the cable-stay cradle system for enclosing the protective sleeves. Grout may be filled within an area defined by the outer surfaces of each of the protective sleeves, the interior surface of the sheath, and the interior surfaces of each of the outermost sleeve centering plates.

The present invention also provides a cable-stayed bridge including a bridge deck, one or more pylons, and a plurality of bridge deck support systems for supporting the bridge deck. Each of the bridge deck support systems includes a cable stay having cable strands. One end of the cable stay is capable of being attached to a first anchor on the bridge deck, and the other end of the cable stay is capable of being attached to a second anchor on the bridge deck. The bridge deck support system further includes curved cable-stay cradle systems having a predetermined. arc-length smaller than the length of the cable stay. The cable-stay cradle systems are disposed along a length of the cable stay, and include axially spaced sleeve centering plates having radially spaced holes through which the cable strands are threaded. The cable-stay cradle system permits a distance from a center-point of a cable strand disposed in a hole, to a center-point of another cable strand disposed in an adjacent hole, to remain essentially constant along the arc-length of the cable-stay cradle system.

The present invention yet further provides a method of installing and inspecting a cable stay for supporting a bridge deck of a cable-stayed bridge having one or more pylons. The method includes the steps of providing a cable stay having cable strands, and installing a curved cable-stay cradle system on the cable stay, the cable-stay cradle system having a predetermined arc-length smaller than the length of the cable stay. The method further includes the steps of threading the cable strands through radially spaced holes provided in axially spaced sleeve centering plates disposed in the cable-stay cradle system, and attaching one end of the cable stay to a first anchor on the bridge deck. The method yet further includes the steps of threading the cable stay through an opening in the pylon so as to orient the cable-stay cradle system within the opening, and attaching the other end of the cable stay to a second anchor on the bridge deck. The cable-stay cradle system permits a distance from a center-point of a cable strand disposed in a hole, to a center-point of another cable strand disposed in an adjacent hole, to remain essentially constant along the arc-length of the cable-stay cradle system. For inspection of the cable strands, the method also includes the steps of releasing a predetermined number of cable strands from the first and second anchors, and thereafter removing the released strands. The method yet further includes the steps of inspecting the removed cable strands, and replacing at least one of the removed cable strands with a new cable strand, threading the replaced cable strand and remaining removed cable strands within the cable stay, and re-attaching the replaced and remaining cable strands to the first and second anchors. If none of the cable strands are replaced, then the removed cable strands are re-threaded within the cable stay, and re-attached to the first and second anchors.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT

Figure 1:
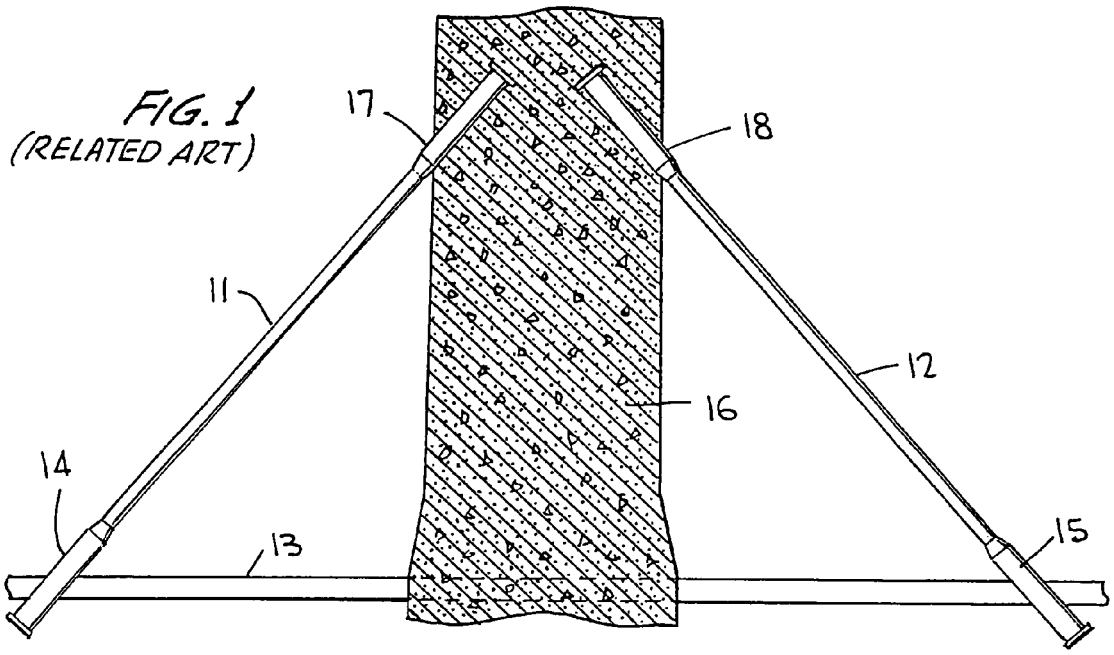
FIG. 1 (RELATED ART)
FIG. 1 is an illustrative sectional view of a related art cable stayed bridge, illustrating cable stays anchored to the bridge deck and the pylon.
Figure 2:
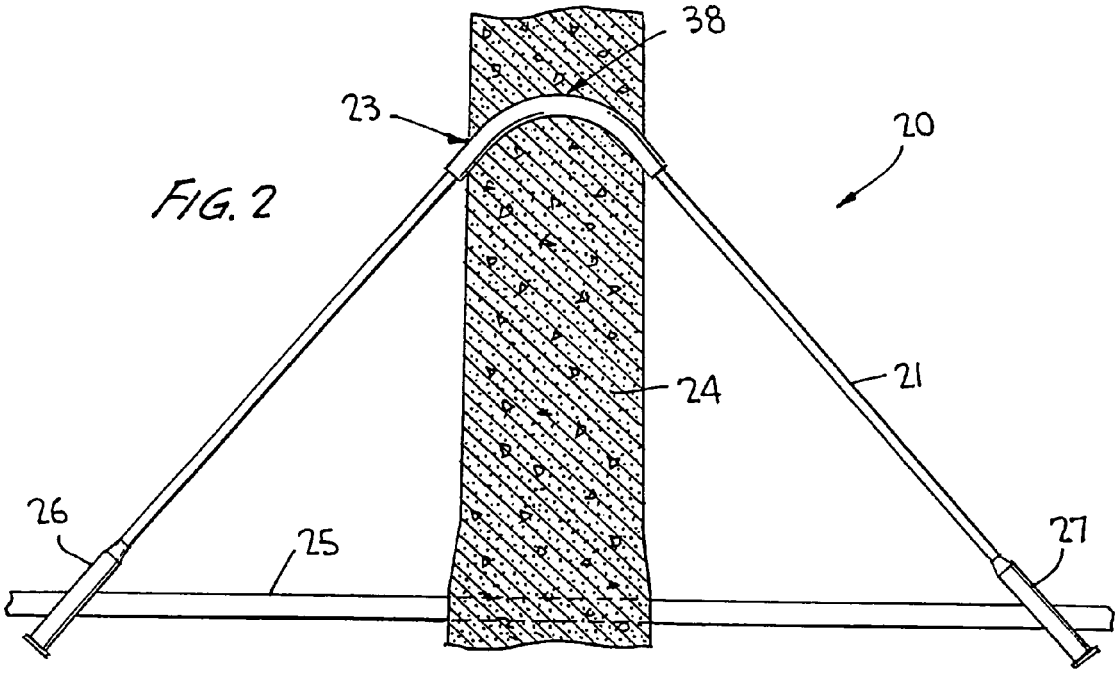
FIG. 2 is an illustrative sectional view of a cable stayed bridge construction according to the present invention, illustrating a cable-stay cradle system supported by a pylon and the cable stay anchored to the bridge deck.

Referring now to the drawings wherein like reference numerals designate corresponding parts throughout the several views, FIG. 2 illustrates a cable-stay cradle system according to the present invention, generally designated 20.

Cable-stay cradle system 20 may be mounted onto vertically spaced cable stays 21 disposed at fixed or variable intervals in suitable pre-formed openings 23 along the vertical length of pylon 24. Cable stay 21 may be anchored to bridge deck 25 by suitable anchors 26, 27 in a conventional manner.

Figure 6:
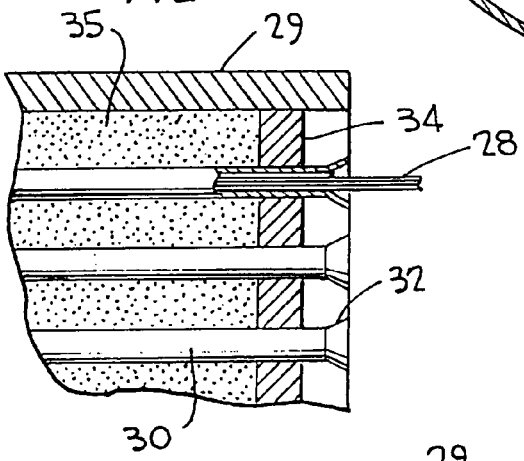
FIG. 6 is an illustrative sectional view of the cable-stay cradle system of FIG. 4, illustrating sleeves for protecting individual strands, and a sleeve centering plate for maintaining the sleeves in an essentially parallel relationship.
Figure 7:
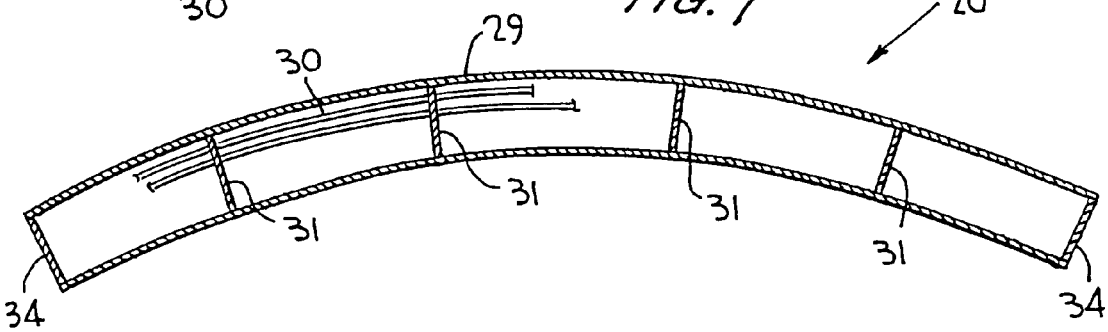
FIG. 7 is an illustrative sectional view of the cable-stay cradle system of FIG. 4, illustrating the spaced parallel relationship of the individual sleeves throughout the cable-stay cradle system.

Referring to FIGS. 4–7, cable-stay cradle system 20 is shown in an assembled configuration having a plurality of cable strands 28 disposed therein, and includes a sheath 29. Cable strands 28 may extend along the length of cable stay 21. Each cable strand 28 may be individually disposed in a protective sleeve 30, and further maintained in spaced radial relationship by sleeve centering plate 31. Each protective sleeve 30 may include an enlarged end 32 for retention thereof in holes 33 of each outer sleeve centering plate 34. As seen in FIG. 7, a plurality of sleeve centering plates 31 may be axially spaced along the length of cable-stay cradle system 20 for maintaining protective sleeves 30 in an essentially parallel configuration. Specifically, sleeve centering plates 31 assure that the distance from the central axis of any given cable strand 28 to the central axis of any other cable strand 28 remains essentially constant along the length of cable-stay cradle system 20, which is disposed in opening 23 of pylon 24. Additionally, grout 35 may be used in the area defined by the outer surface of protective sleeves 30, the inner surface of sleeve centering plates 34 and the inner surface of sheath 29, for retention of protective sleeves 30 in an essentially parallel configuration. This parallel spaced (or radially fixed) configuration eliminates the direct contact stresses associated with frictional contact of cable strands 28 in conventional cable stayed bridge, in which cable strands become bunched within the pylon opening. Additionally, this parallel spaced configuration permits a vertical deviation of cable stay 21, without each strand 28 coming in direct contact with opening 23 of pylon 24 and with the inner surfaces of sheath 29.

Figure 3:
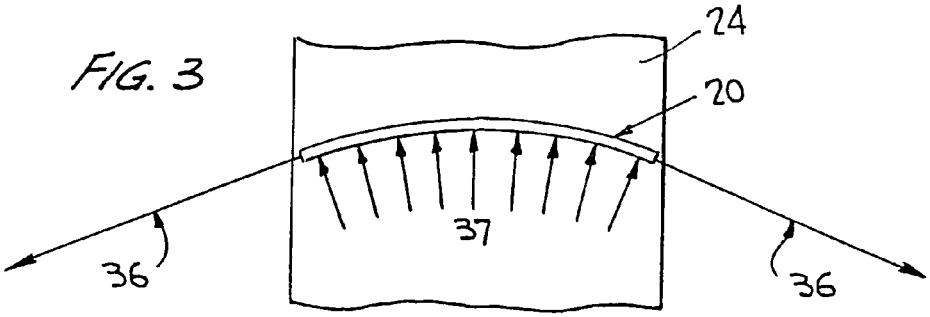
FIG. 3 is an illustrative view of compressive stress transferred onto a pylon by the cable-stay cradle system of the present invention.
Figure 4:
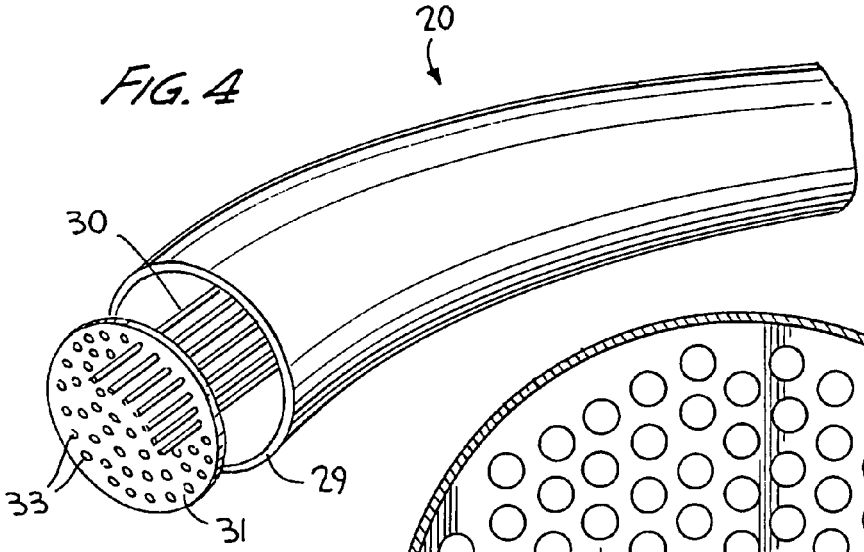
FIG. 4 is a perspective broken view of the cable-stay cradle system according to the present invention, illustrating a sleeve centering plate for maintaining individual strands in an essentially parallel relationship.
Figure 5:
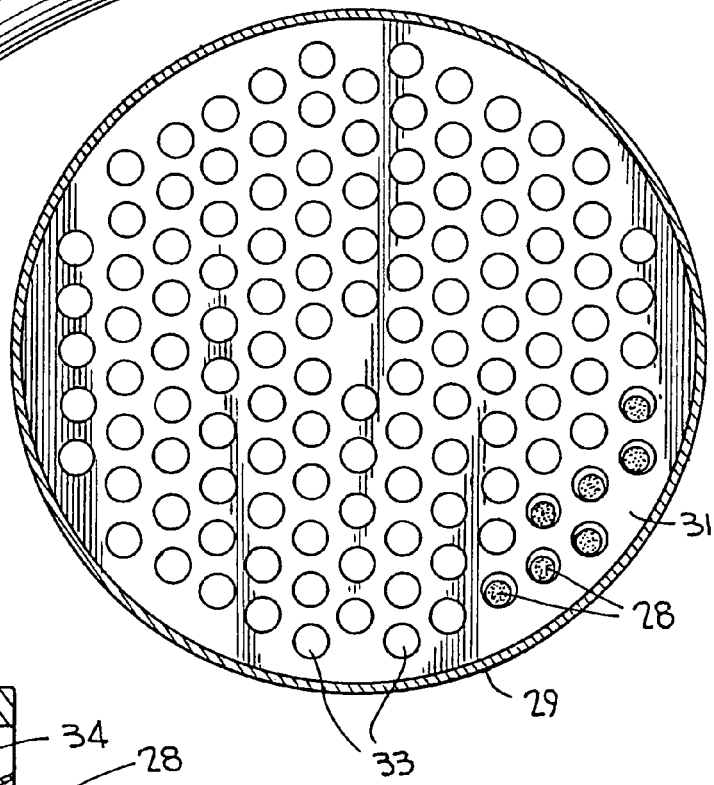
FIG. 5 is an illustrative front sectional view of the cable-stay cradle system of FIG. 4.

Referring to FIGS. 2 and 3, upon installation of cable-stay cradle system 20 onto a bridge pylon 24, each cable stay 21 generates a tensile force 36 in the direction of anchors 26, 27. Each cable stay 21, in the region of cable-stay cradle system 20, also generates compressive stress 37 on pylon 24. This compressive stress 37 is transferred in a vertical direction along the axial length of pylon 24, thus allowing pylon 24 to be built relative thin, as compared to pylons in which cable stays are directly anchored to the pylon. As illustrated in FIGS. 3 and 7, it is apparent that since each protective sleeve 30 and hence each cable strand 28 is maintained in an essentially parallel (or radially fixed) configuration along the arc-length of cable-stay cradle system 20, compressive stress 37 has a symmetrical distribution along opening 23 in pylon 24.

Accordingly, compared to conventional cable stays in which the individual strands bunch up at the vertical deviation point (i.e. adjacent to point 38 in FIG. 2), each protective sleeve 30 and hence each cable strand 28 is maintained in an essentially parallel configuration along the entire arc-length of cable-stay cradle system 20. Moreover, compared to conventional cable stays in which the vertical compressive force at the vertical deviation point is transferred through individual strands onto a pylon, the vertical compressive force for cable-stay cradle system 20 of the present invention is transferred through grout 35 onto pylon 24, and is therefore uniformly applied on pylon 24.

The cable-stay cradle system 20 of the present invention, upon installation thereof onto a cable stay 21, also permits inspection of a cable stay 21 by complete removal of a predetermined number of reference cable strands 28, which may be removed entirely from a cable stay 21 and inspected for deterioration. Such removal and inspection of an entire cable strand 28 is only possible because of the relatively parallel orientation of each cable strand 28, relative to the other cable strands 28, throughout the entire arc-length of cable-stay cradle system 20, and hence of cable stay 21, compared to the conventional cable stays described above in which the strands are compressed and bunched in the vertical deviation region 38.

Installation and inspection of an exemplary embodiment of a cable-stay cradle system 20 will now be described.

Referring to FIGS. 2–7, in order to install a cable-stay cradle system 20, first a cable stay 21 having a plurality of cable strands 28 is provided. Each cable strand 28 may be disposed inside a stainless steel protective sleeve 30 having a length approximately the same as the arc-length of cable-stay cradle system 20, and each protective sleeve 30 may be centered onto a longitudinally central location on each cable strand 28. Each protective sleeve 30 may then be threaded through holes 33 in sleeve centering plates 31 of cable-stay cradle system 20, which includes a sheath 29 having a plurality of spatially disposed sleeve centering plate 31. The spaces between the protective sleeves 30 may then be grouted and the ends of each protective sleeve 30 may be enlarged, as shown in FIG. 6, for retention thereof in cable-stay cradle system 20. The cable stay 21, which now includes a cable-stay cradle system 20 mounted thereon, may then be anchored to bridge deck 25 by a suitable anchor 26, threaded through opening 23 in pylon 24, and thereafter anchored to bridge deck 25 by a suitable anchor 27, as illustrated in FIG. 2. In order to inspect an installed cable stay 21, as described above, a predetermined number of reference cable strands 28 may be detached from anchors 26 and 27, removed entirely from a cable stay 21 and inspected for deterioration. After inspection, the removed cable strands 28 may be re-threaded back through their original holes 33 in sleeve centering plates 31, or replaced in their entirety, and thereafter re-attached to anchors 26 and 27 in a conventional manner.

It is apparent that the various components discussed above for cable-stay cradle system 20 may be made of stainless steel, HDPE, carbon steel or other equivalent materials, as would be apparent to a skilled artisan.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A method of installing and inspecting a cable stay for supporting a bridge deck of a cable-stayed bridge having at least one pylon, said method comprising the steps of:

providing a cable stay including a plurality of cable strands;

installing along a length of said cable stay, at least one curved cable-stay cradle system having a predetermined arc-length smaller than the length of said cable stay;

threading said cable strands through radially spaced holes provided in a plurality of axially spaced sleeve centering plates disposed in said cable-stay cradle system;

attaching one end of said cable stay to a first anchor on the bridge deck;

threading said cable stay through an opening in the pylon so as to orient said cable-stay cradle system within the opening; and attaching the other end of said cable stay to a second anchor on the bridge deck, wherein a distance from a center-point of a cable strand disposed in a hole, to a center-point of another cable strand disposed in an adjacent hole, remains essentially constant along the arc-length of said cable-stay cradle system.

2. A method according to claim 1, further comprising the step of enclosing said cable strands with a covering.

3. A method according to claim 1, further comprising the step of enclosing each of said cable strands in a protective sleeve along a predetermined length of said cable stay, each of said protective sleeves having a length substantially the same as the arc-length of said cable-stay cradle system.

4. A method according to claim 3, wherein said sleeve centering plates include first and second outermost sleeve centering plates each having interior and exterior surfaces, said method further comprising the steps of:

threading each of said protective sleeves through said holes in said sleeve centering plates; and expanding outer ends of at least one of said protective sleeves adjacent said exterior surfaces of each of said outermost sleeve centering plates for retention thereof within said cable-stay cradle system.

5. A method according to claim 4, further comprising the step of enclosing said protective sleeves with a sheath having a length substantially the same as the arc-length of said cable-stay cradle system.

6. A method according to claim 5, further comprising the step of grouting an area defined by outer surfaces of each of said protective sleeves, an interior surface of said sheath, and the interior surfaces of each of said outermost sleeve centering plates.

7. A method according to claim 5, wherein said sheath, said protective sleeves, and said sleeve centering plates are made of metal.

8. A method according to claim 1, further comprising the steps of:

releasing a predetermined number of cable strands from the first anchor;

releasing the predetermined number of said cable strands from the second anchor;

removing the predetermined number of said cable strands from said cable stay;

inspecting said removed cable strands; and one of:

replacing at least one of said removed cable strands with a new cable strand, threading said replaced cable strand and remaining removed cable strands within said cable stay, and re-attaching said replaced and remaining cable strands to said first and second anchors; and re-threading said removed cable strands within said cable stay, and re-attaching said removed cable strands to said first and second anchors.

* * * * *